US011370091B2

(12) United States Patent
Hu

(10) Patent No.: US 11,370,091 B2
(45) **Date of Patent: *Jun. 28, 2022**

(54) ELECTRIC RATCHET WRENCH

(71) Applicant: Bobby Hu, Taichung (TW)

(72) Inventor: Bobby Hu, Taichung (TW)

(73) Assignee: Bobby Hu, Taichung (TW)

( * ) Notice: Subject to any disclaimer, the term of this patent is extended or adjusted under 35 U.S.C. 154(b) by 524 days.

This patent is subject to a terminal disclaimer.

(21) Appl. No.: 16/238,894

(22) Filed: Jan. 3, 2019

(65) Prior Publication Data

US 2019/0134792 A1 May 9, 2019

Related U.S. Application Data

(63) Continuation of application No. 14/753,058, filed on Jun. 29, 2015, now Pat. No. 10,232,495.

(30) Foreign Application Priority Data

May 22, 2015 (TW) ..... 104116570

(51) Int. Cl.

| | |
|---|---|
| ***B25B 21/00*** | (2006.01) |
| ***B25B 13/46*** | (2006.01) |
| ***B25B 23/00*** | (2006.01) |
| ***B25B 23/14*** | (2006.01) |

(52) U.S. Cl.

CPC ..... *B25B 21/004* (2013.01); *B25B 13/465* (2013.01); *B25B 23/0035* (2013.01); *B25B 23/141* (2013.01)

(58) Field of Classification Search

CPC ..... B25B 13/465

See application file for complete search history.

(56) References Cited

U.S. PATENT DOCUMENTS

| | | | |
|---|---|---|---|
| 2,179,724 | A | 11/1939 | Kuehne |
| 2,614,418 | A | 10/1952 | Shaff |
| 2,621,767 | A | 12/1952 | McDevitt |
| 2,808,749 | A | 10/1957 | Lampke |
| 3,491,616 | A | 1/1970 | Albert |

(Continued)

FOREIGN PATENT DOCUMENTS

| | | | |
|---|---|---|---|
| CN | 201020685 | Y | 2/2008 |
| CN | 101269484 | A | 9/2008 |

(Continued)

*Primary Examiner* — Hadi Shakeri

(74) *Attorney, Agent, or Firm* — Viering, Jentschura & Partner MBB

(57) ABSTRACT

An electric ratchet wrench includes a body and a driving member rotatably mounted in the body and is rotatable about an axis. A ring gear is rotatably mounted to and moveable relative to the driving member, and the ring gear is rotatable relative to the driving member about a center axis of the ring gear. A power device is received in the body. A transmission shaft is rotatably mounted to the body. The transmission shaft has a end connected to the power device, and another end configured to switch between a meshing state meshed with the ring gear and a disengagement state disengaging from the ring gear. An elastic device biases the ring gear causing the center axis of the ring gear being inclined relative to the axis in the disengagement state and being parallel with the axis in the meshing state.

20 Claims, 13 Drawing Sheets

(56) References Cited

U.S. PATENT DOCUMENTS

| | | | | |
|---|---|---|---|---|
| 3,707,893 | A | 1/1973 | Hofman | |
| 3,756,090 | A | 9/1973 | Mella et al. | |
| 3,789,706 | A | 2/1974 | Smith | |
| 3,942,337 | A * | 3/1976 | Leonard | B25B 23/141 464/36 |
| 4,023,744 | A | 5/1977 | Shutt | |
| 4,062,203 | A | 12/1977 | Leonard et al. | |
| 4,524,649 | A | 6/1985 | Diaz et al. | |
| 4,653,359 | A | 3/1987 | Liao | |
| 5,058,463 | A | 10/1991 | Wannop | |
| 5,305,670 | A | 4/1994 | Fossella et al. | |
| 5,709,136 | A | 1/1998 | Frenkel | |
| 6,062,939 | A | 5/2000 | Parker et al. | |
| 6,070,499 | A | 6/2000 | Wisbey | |
| 6,131,489 | A | 10/2000 | Yang | |
| 6,209,422 | B1 | 4/2001 | Kamiya et al. | |
| 6,216,562 | B1 | 4/2001 | Hsieh | |
| 6,311,584 | B1 | 11/2001 | Chu | |
| 6,457,386 | B1 | 10/2002 | Chiang | |
| 6,568,298 | B1 | 5/2003 | Zinck | |
| 7,104,165 | B2 | 9/2006 | Chu | |
| 7,267,033 | B1 | 9/2007 | Lai | |
| 7,406,900 | B1 | 8/2008 | Hsieh | |
| 7,444,902 | B1 | 11/2008 | Lin et al. | |
| 7,571,668 | B1 | 8/2009 | Chang | |
| 8,430,868 | B2 * | 4/2013 | Edgell | A61N 1/3752 606/1 |
| 8,602,899 | B2 * | 12/2013 | You | F16D 7/08 464/36 |
| 8,800,410 | B1 | 8/2014 | Huang | |
| 9,038,505 | B2 | 5/2015 | He | |
| 10,756,482 | B2 * | 8/2020 | Burns | H01R 13/623 |
| 2003/0144615 | A1 | 7/2003 | Lin | |
| 2004/0226411 | A1 | 11/2004 | Hsien | |
| 2005/0090216 | A1 | 4/2005 | Hsu et al. | |
| 2006/0060032 | A1 | 3/2006 | Baker | |
| 2007/0084310 | A1 | 4/2007 | Baker | |
| 2008/0271574 | A1 | 11/2008 | Lin et al. | |
| 2009/0114058 | A1 | 5/2009 | Malone | |
| 2009/0114068 | A1 | 5/2009 | Lawrence | |
| 2014/0157961 | A1 | 6/2014 | Chen | |
| 2016/0075002 | A1 | 3/2016 | Hu et al. | |
| 2016/0075003 | A1 | 3/2016 | Hu et al. | |
| 2016/0339567 | A1 | 11/2016 | Hu | |
| 2016/0339568 | A1 | 11/2016 | Hu | |

FOREIGN PATENT DOCUMENTS

| | | | |
|---|---|---|---|
| DE | 20309684 | U1 | 9/2003 |
| EP | 2995425 | A1 | 3/2016 |
| GB | 1263348 | A | 2/1972 |
| JP | S62136378 | A | 6/1987 |
| JP | H0531873 | U | 4/1993 |
| JP | H0624867 | U | 4/1994 |
| JP | 2004106161 | A | 4/2004 |
| TW | 404298 | U | 9/2000 |
| TW | I232791 | B | 5/2005 |
| TW | M290086 | U | 5/2006 |
| TW | I292733 | B | 1/2008 |
| TW | 200838649 | A | 10/2008 |
| TW | I318912 | B | 1/2010 |
| TW | I319733 | B | 1/2010 |
| TW | M377293 | U | 4/2010 |
| TW | M413569 | U | 10/2011 |
| TW | M449063 | U | 3/2013 |
| WO | 2008018221 | A1 | 2/2008 |

* cited by examiner

ELECTRIC RATCHET WRENCH

CROSS-REFERENCE

The present application is a continuation of prior U.S. patent application Ser. No. 14/753,058, filed on Jun. 29, 2015, entitled "ELECTRIC RATCHET WRENCH", which claims priority of Taiwan patent application Ser. No. 104116570, filed on May 22, 2015, the entirety of which is incorporated herein by reference.

FIELD OF THE INVENTION

The present invention relates to a ratchet wrench and, more particularly, to an electric ratchet wrench.

BACKGROUND

U.S. Pat. No. 8,800,410 discloses a ratchet wrench with a direction switching structure. The ratchet wrench includes a wrench body, a ratchet wheel, a ratcheting member, and a switching member. The ratchet wheel is rotatably mounted in the wrench body and can couple with a socket. The ratcheting member is mounted in the wrench body and is selectively engaged with the ratchet wheel by using a left half portion or a right half portion of ratchet teeth of the ratcheting member to switch the rotating direction of the ratchet wheel. The switching member is pivotably mounted in the body and abuts the ratcheting member.

A user has to grip the wrench body and rotate the wrench body in opposite directions to drive the socket in a single direction. Long bolts are commonly used in a building construction site. Considerable time is required for repeated operations of the long bolts in opposite directions. Furthermore, the long bolts are apt to rust in outdoor building construction sites, and the user has to spend time and effort to tighten or loosen the rusted long bolts with conventional ratchet wrenches.

Thus, a need exists for a novel electric ratchet wrench to mitigate and/or obviate the above disadvantages.

BRIEF SUMMARY

This need and other problems in the field of easy driving of ratchet wrenches are solved by an electric ratchet wrench including a body, a driving member, a first ring gear, a power device, a transmission shaft, and an elastic device. The driving member is rotatably mounted in the body and is rotatable about a second axis. The first ring gear is rotatably mounted to and is moveable relative to the driving member. The first ring gear is rotatable relative to the driving member in a clockwise direction or a counterclockwise direction about a center axis of the first ring gear. The power device is received in the body. The transmission shaft is rotatably mounted to the body. The transmission shaft includes a first end connected to the power device, and a second end configured to switch between a meshing state meshed with the first ring gear and a disengagement state disengaging from the first ring gear. The elastic device biases the first ring gear towards the transmission shaft and from the disengagement state to the meshing state. The elastic device causes the center axis of the first ring gear being inclined relative to the second axis in the disengagement state and being parallel with the second axis in the meshing state.

The body includes a first end and a second end spaced from the first end along a first axis. The first end of the body includes an inner periphery having a toothed portion. A driving device is mounted to the first end of the body. The driving device includes the driving member, a pawl device pivotably mounted to the driving member, and the first ring gear rotatably mounted around the driving member. The driving member includes an end adapted for directly or indirectly driving a fastener. The pawl device is configured to selectively mesh with the toothed portion of the body. The first ring gear includes an inner toothed portion on an inner periphery thereof and an end toothed portion on an end face thereof. The inner toothed portion of the first ring gear is configured to selectively mesh with the pawl device. The elastic device is mounted between the first end of the body and the first ring gear. The power device is received in the second end of the body and includes a motor. A transmission device includes the transmission shaft having the first end connected to the motor and the second end configured to switch between the meshing state meshed with the end toothed portion of the first ring gear and the disengagement state disengaging from the end toothed portion of the first ring gear.

In an example, the body includes a connection hole. The transmission shaft is received in the connection hole and is rotatable about the first axis. The second end of the transmission shaft includes a gear normally meshed with the end toothed portion of the first ring gear. The gear of the transmission shaft is switchable between the meshing state and the disengagement state. The transmission shaft deviates from the first axis when the gear of the transmission shaft is in the disengagement state, such that a tooth slippage phenomenon occurs between the gear of the transmission shaft and the end toothed portion of the first ring gear.

In another example, the body includes a connection hole. The transmission shaft is received in the connection hole and is rotatable about the first axis. The second end of the transmission shaft includes a gear normally meshed with the end toothed portion of the first ring gear. The gear of the transmission shaft is switchable between the meshing state and the disengagement state. The transmission shaft deviates from the first axis when the gear of the transmission shaft is in the disengagement state. The gear of the transmission shaft presses the first ring gear to move relative to the body and to compress the elastic device.

In a further example, the body includes a connection hole. The transmission shaft is received in the connection hole and is rotatable about the first axis. The second end of the transmission shaft includes a gear normally meshed with the end toothed portion of the first ring gear. The gear of the transmission shaft is switchable between the meshing state and the disengagement state. The gear of the transmission shaft presses the first ring gear to move relative to the body and to compress the elastic device when the gear of the transmission shaft is in the disengagement state.

The body can further include a cover mounted to the first end of the body. The elastic device is mounted between the cover and the first ring gear. The elastic device includes a first elastic member and an abutment member. The first elastic member is located between the first ring gear and the abutment member. The abutment member is mounted to the first end of the body and abuts the cover.

In an example, the first elastic member can be a wave spring mounted around the driving member.

The driving device can further include a second ring gear rotatably mounted around the driving member. Each of the first and second ring gears is rotatable about a second axis perpendicular to the first axis in the clockwise direction or the counterclockwise direction. The second ring gear includes an inner toothed portion on an inner periphery thereof and an end toothed portion on an end face thereof. The gear of the transmission shaft normally meshes with the end toothed portions of the first and second ring gears. The gear of the transmission shaft is switchable between the meshing state and the disengagement state. The pawl device includes two primary pawls, a first secondary pawl, and a second secondary pawl. Each of the two primary pawls is pivotably mounted to the driving member and is configured to selectively mesh with the toothed portion of the body. The inner toothed portion of the first ring gear is configured to selectively mesh with the first secondary pawl. The inner toothed portion of the second ring gear is configured to selectively mesh with the second secondary pawl. When the gear of the transmission shaft is in the meshing state, the gear of the transmission shaft meshes with the end toothed portions of the first and second ring gears. On the other hand, when the gear of the transmission shaft is in the disengagement state, the tooth slippage phenomenon occurs between the gear of the transmission shaft and the end toothed portions of the first and second ring gears, and the gear of the transmission shaft presses the first ring gear to move relative to the body and compress the first elastic member of the elastic device.

The elastic device can further include a second elastic member mounted between the second ring gear and the driving member.

In another example, the first elastic member can be a coil spring, and the abutment member includes a first positioning groove having an opening facing the first ring gear. The first elastic member has a first end engaged in the first positioning groove of the abutment member.

The elastic device can further include a first spring seat having a connection section and an abutment section integrally formed with the connection section. The first elastic member further has a second end mounted around the connection section of the first spring seat. The abutment section of the first spring seat abuts the first ring gear.

The abutment member can further include a second positioning groove having an opening facing the first ring gear. The elastic device can further include a second elastic member and a second spring seat. The second elastic member is a coil spring having first and second ends. The second spring seat includes a connection section and an abutment section integrally formed with the connection section. The first end of the second elastic member is engaged in the second positioning groove. The second end of the second elastic member is mounted around the connection section of the second spring seat. The abutment section of the second spring seat abuts the first ring gear. The first and second spring seats are diametrically opposed to each other relative to the second axis.

The transmission device can further include a restraining member mounted in the first end of the body and receiving the transmission shaft. The restraining member includes a restraining groove extending in a radial direction perpendicular to the first axis. The transmission shaft extends through and restrained by the restraining groove, such that when the transmission shaft deviates away from the first axis, the second end of the transmission shaft deviates along an axis parallel to the second axis perpendicular to the first axis.

The electric ratchet wrench can further include a direction switching device having a direction switching rod extending through the driving member along a second axis perpendicular to the first axis. The direction switching rod is pivotable relative to the driving member between two positions respectively corresponding to a driving direction and a non-driving direction. The pawl device includes two primary pawls, a first secondary pawl, and a second secondary pawl. The two primary pawls are configured to selectively be meshed with the toothed portion of the body. The inner toothed portion of the first ring gear is configured to selectively mesh with the first secondary pawl. The inner toothed portion of the second ring gear is configured to selectively mesh with the second secondary pawl. When the direction switching rod pivots between the two positions, an engagement status between each of the two primary pawls and the toothed portion of the body and an engagement status between the first and second secondary pawls and the first and second ring gears are changed to provide a direction switching function.

The body can include a head, a handle adapted to be held by a user, and an extension between the head and the handle. The head is located on the first end of the body. The handle is located between the extension and the second end of the body along the first axis. The head includes a driving hole and a transmission groove intercommunicated with the driving hole. The driving hole includes the inner periphery having the toothed portion. The handle includes a compartment receiving the power device. The connection hole is defined in the extension. The handle of the body includes a through-hole extending in a radial direction perpendicular to the first axis. The through-hole intercommunicates with the compartment. The power device can further include a power source and a control button. The motor includes a motor shaft. The power source is electrically connected to the motor for driving the motor shaft to rotate. The motor can be a monodirectional motor. The motor shaft and the transmission shaft are rotatable about the first axis. The control button is received in the through-hole of the body and is electrically connected to the motor. The control button can be operated to control the motor.

The driving device can further include first and second pins. The first pin extends through the driving member, one of the two primary pawls, and the first secondary pawl, permitting the one of the two primary pawls and the first secondary pawl to jointly pivot relative to driving member about a third axis parallel to the second axis and defined by the first pin. The second pin extends through the other primary pawl and the second secondary pawl, permitting the other primary pawl and the second secondary pawl to jointly pivot relative to driving member about a fourth axis parallel to the second axis and defined by the second pin. The second axis is located between the third and fourth axes. The two primary pawls are located on the same level along the second axis. The first secondary pawl and the second secondary pawl are opposed to each other in a diametric direction perpendicular to the second axis and are located on different levels along the second axis. The two primary pawls are located between the first and second secondary pawls along the second axis.

The direction switching rod can include a through-hole extending in a diametric direction perpendicular to the second axis. The direction switching rod can further include first and second receptacles. The through-hole of the direction switching rod is located between the first and second receptacles along the second axis. Each of the first and second receptacles has an opening. The openings of the first and second receptacles face away from each other and are diametrically opposed to each other. The direction switching device can further include a primary pressing unit and two secondary pressing units. The primary pressing unit is mounted in the through-hole of the direction switching rod and includes two first pressing members and a first biasing element mounted between the two first pressing members and biasing the two first pressing members to respectively press against the two primary pawls. Each of the two secondary pressing units includes a second pressing member and a second biasing element. One of the two secondary pressing units is mounted in the first receptacle of the direction switching rod. The second biasing element received in the first receptacle biases the second pressing member received in the first receptacle to press against the first secondary pawl. The other secondary pressing unit is mounted in the second receptacle of the direction switching rod. The second biasing member received in the second receptacle biases the second pressing member received in the second receptacle to press against the second secondary pawl.

The first end of the transmission shaft can be at a fixed location along the first axis, and the first end of the transmission shaft remains at the fixed location while the transmission shaft shifts between the meshing and disengaging states.

The center axis of the first ring gear can be coincides with the second axis in the meshing state.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
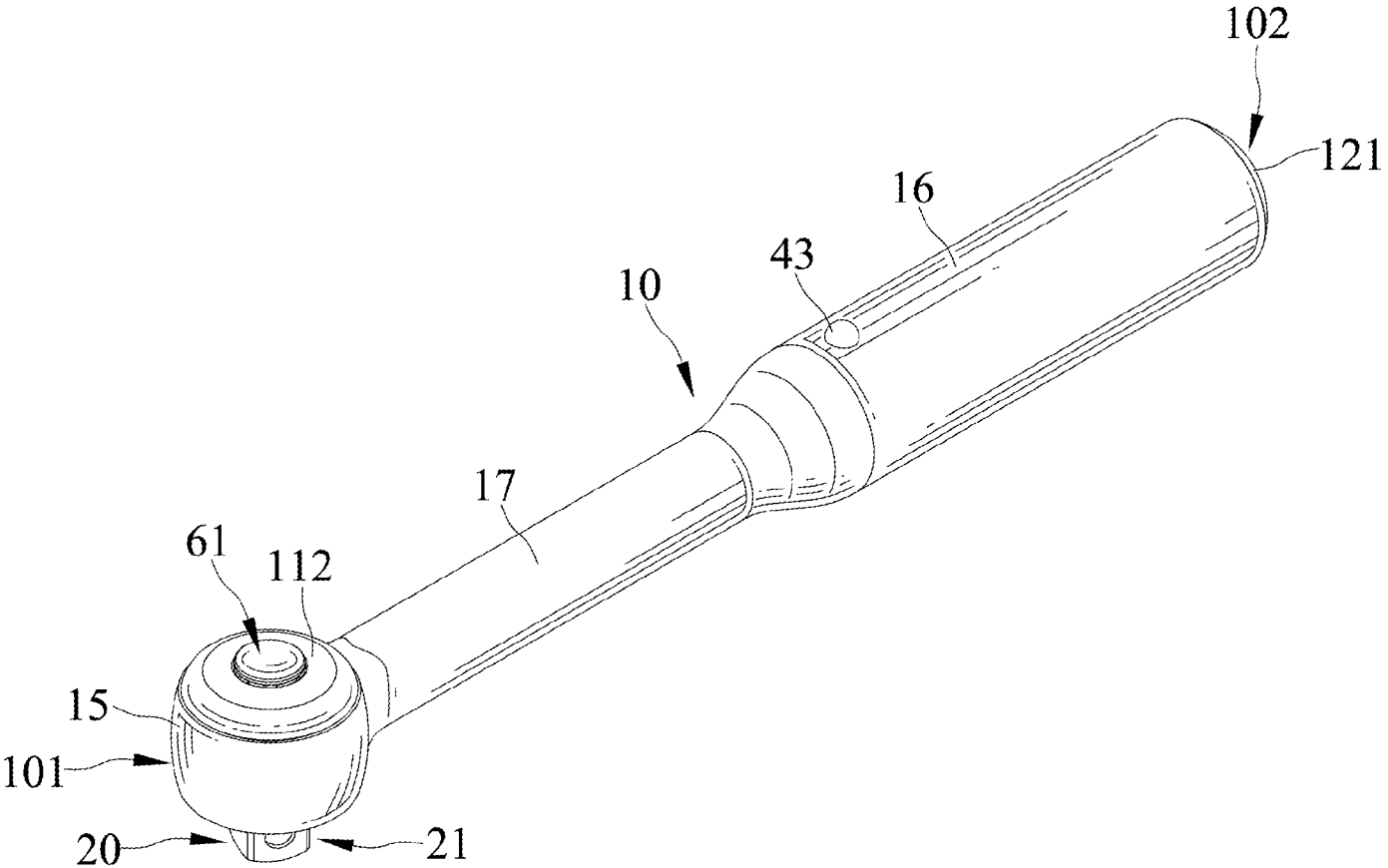
FIG. 1 is a perspective view of an electric ratchet wrench of a first embodiment according to the present invention.
Figure 2:
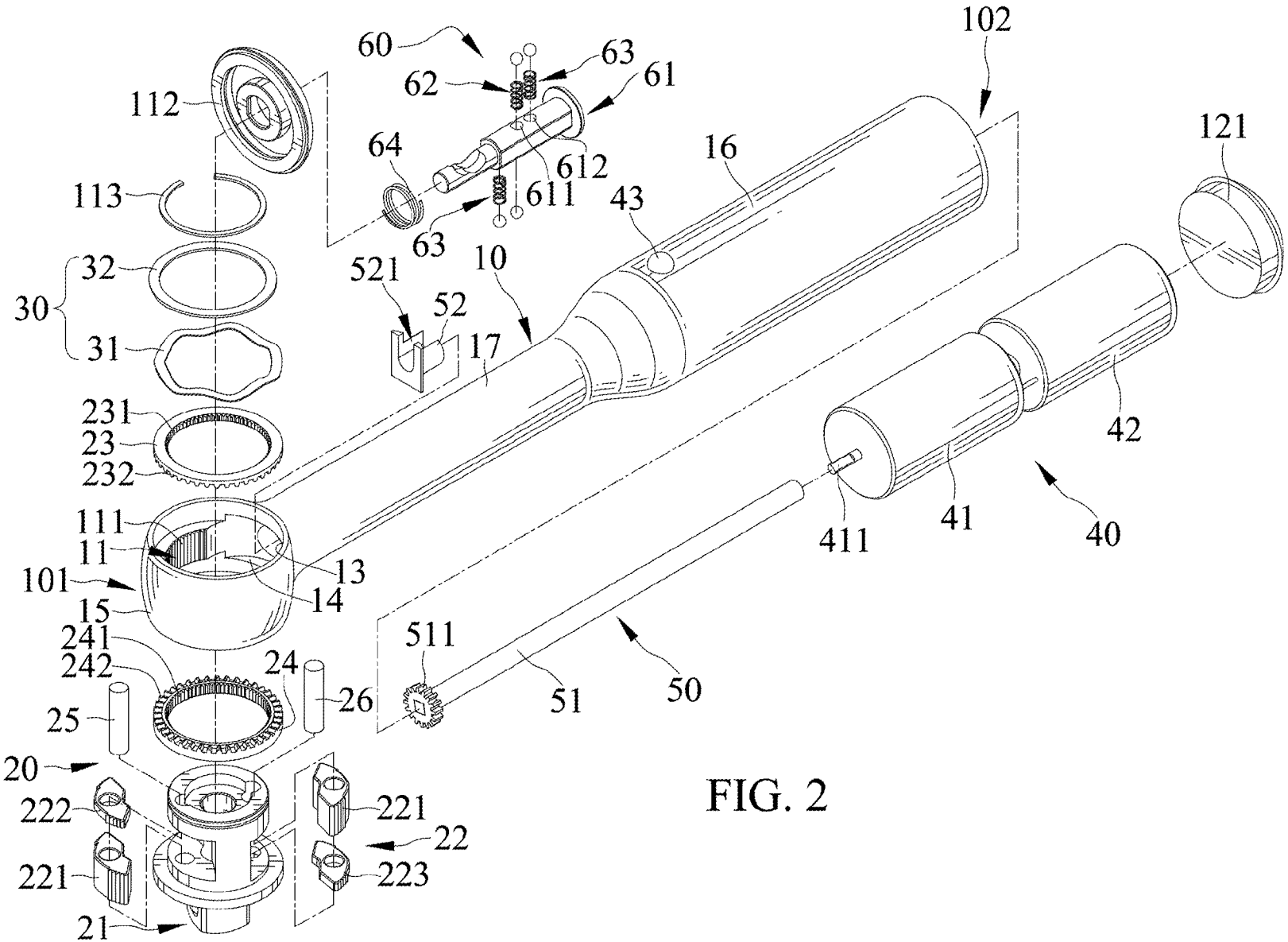
FIG. 2 is an exploded, perspective view of the electric ratchet wrench of FIG. 1.
Figure 3:
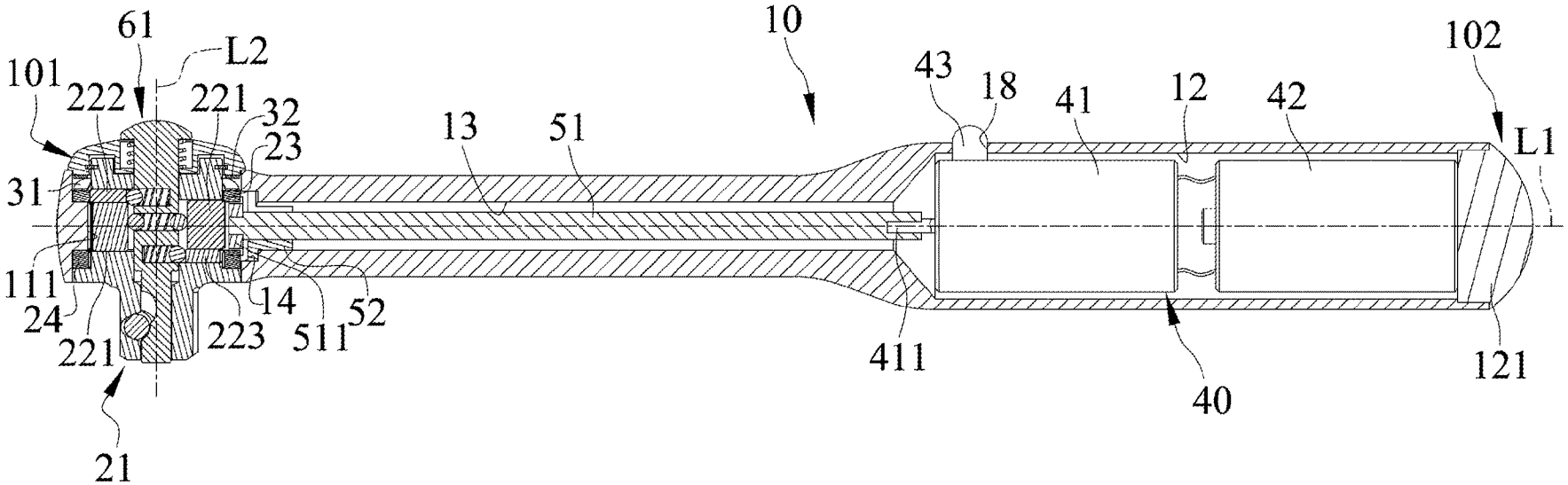
FIG. 3 is a cross sectional view of the electric ratchet wrench of FIG. 1 with a gear of a transmission shaft meshed with first and second ring gears.
Figure 4:
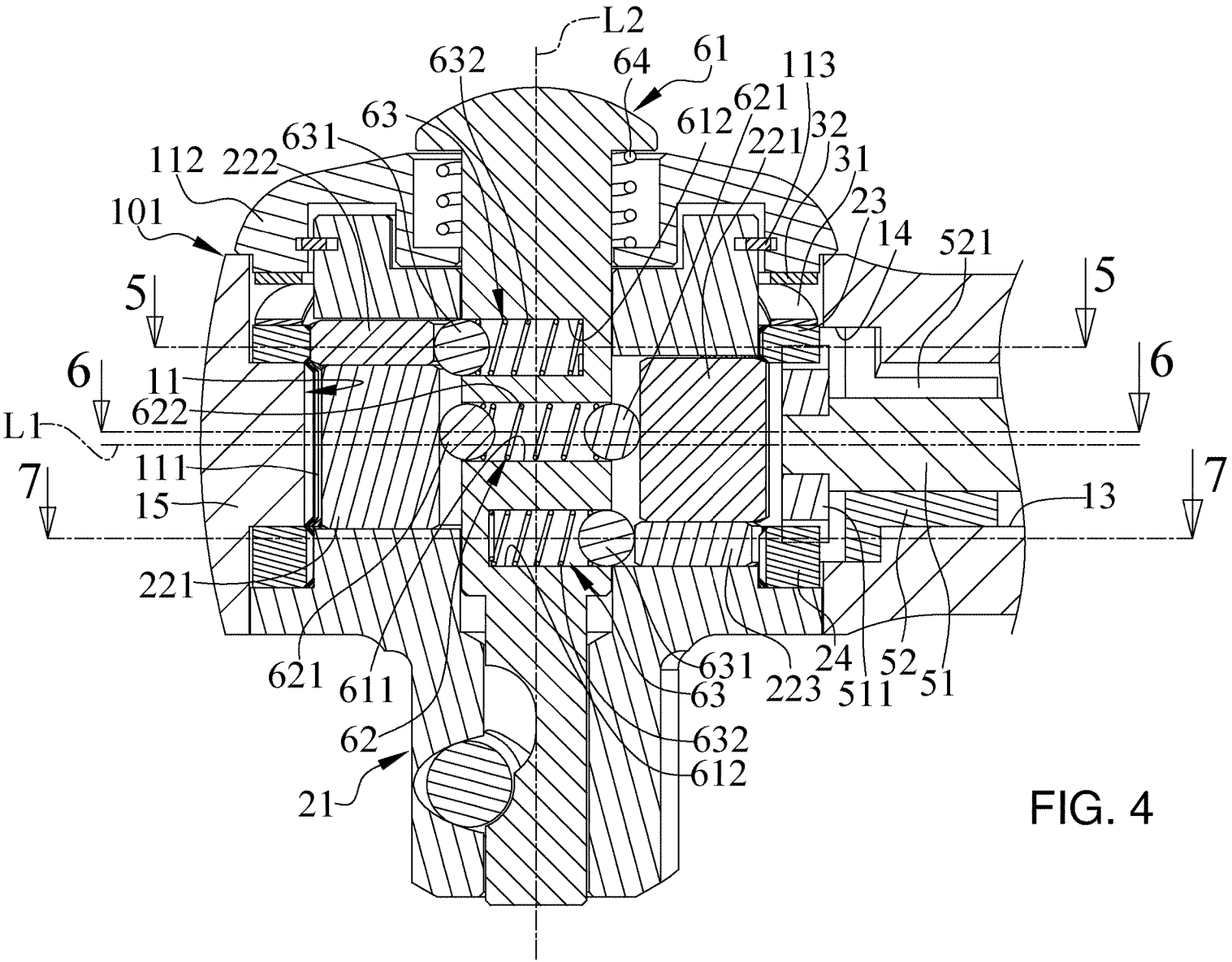
FIG. 4 is an enlarged view of a portion of FIG. 3.
Figure 5:
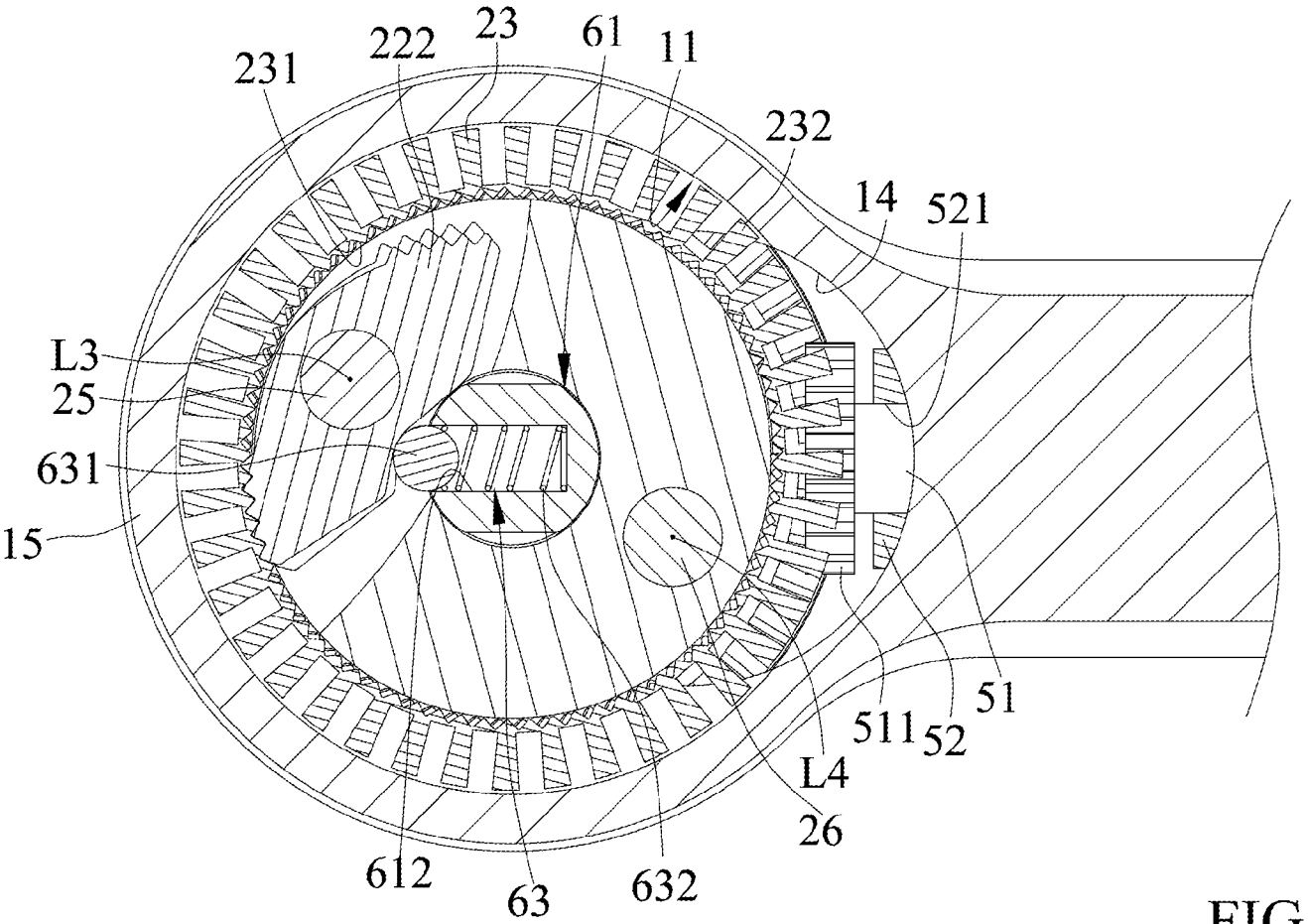
FIG. 5 is a cross sectional view taken along section line 5-5 of FIG. 4.
Figure 6:
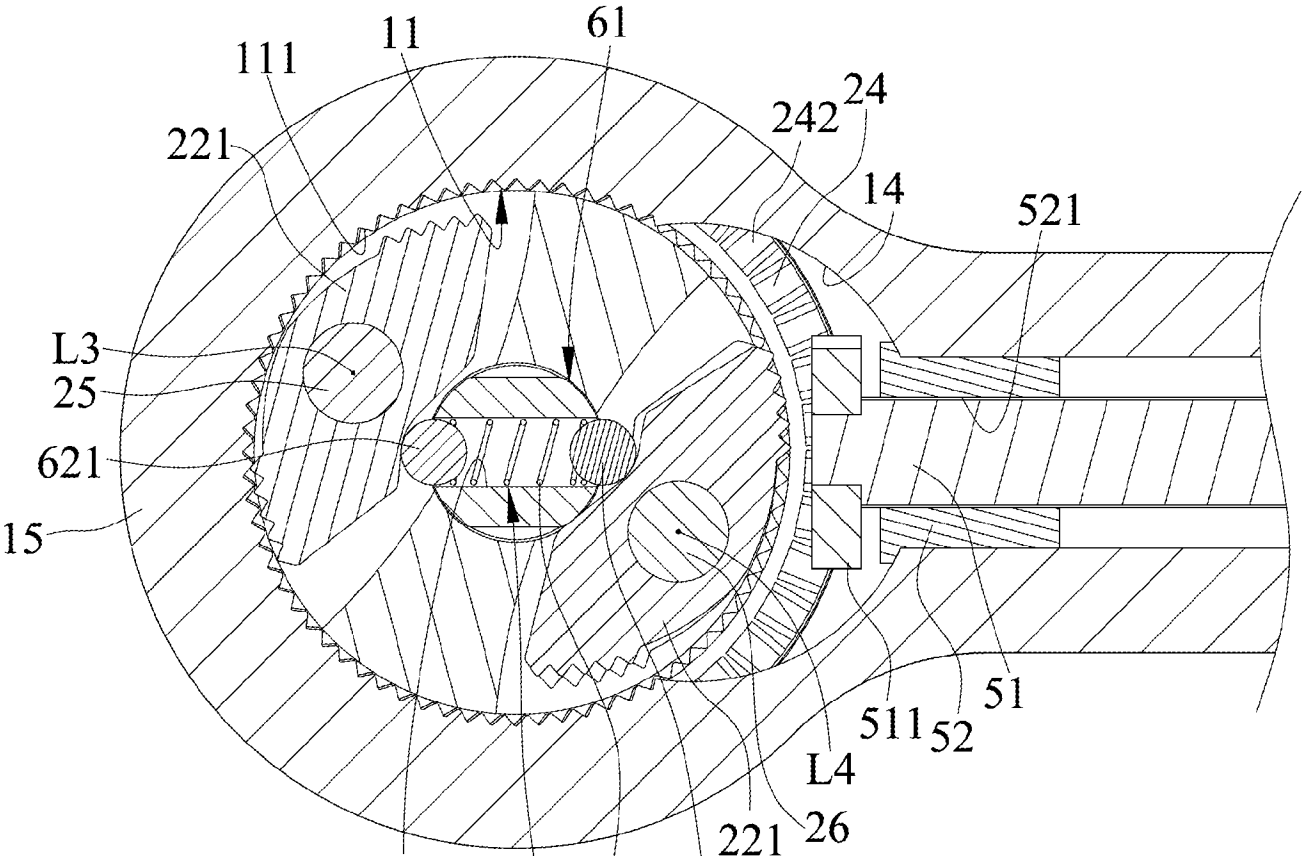
FIG. 6 is a cross sectional view taken along section line 6-6 of FIG. 4.
Figure 7:
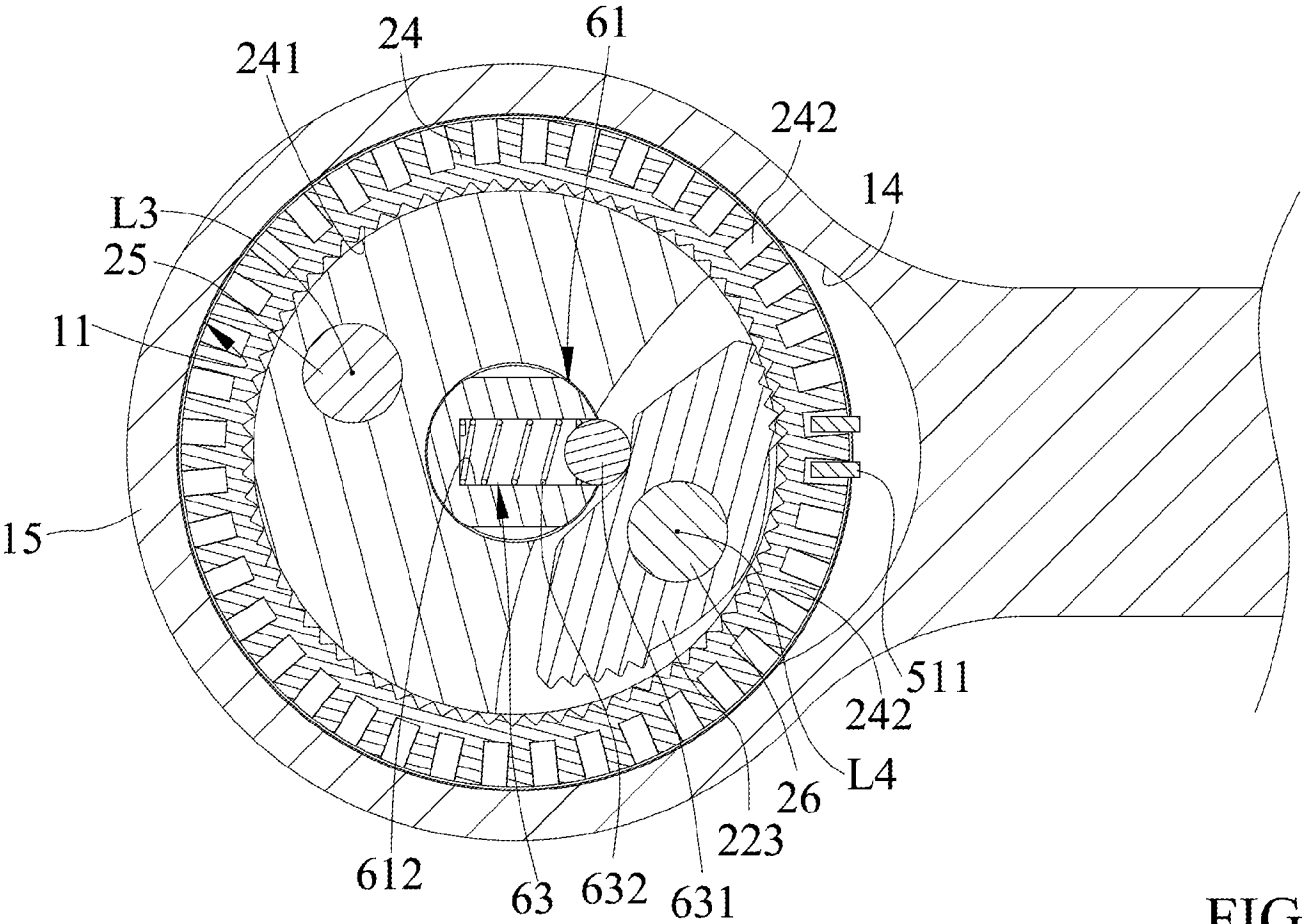
FIG. 7 is a cross sectional view taken along section line 7-7 of FIG. 4.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "bottom", "side", "end", "portion", "section", "spacing", "length", "depth", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION

FIGS. 1-8 show an electric ratchet wrench of a first embodiment according to the present invention. The electric ratchet wrench includes a body 10, a driving device 20, an elastic device 30, a power device 40, and a transmission device 50.

Body 10 includes a first end 101 and a second end 102 spaced from first end 101 along a first axis L1. Body 10 further includes a driving hole 11, a compartment 12, a connection hole 13, and a transmission groove 14. Driving hole 11 is defined in first end 101 of body 10 and includes an inner periphery having a toothed portion 111 distant to compartment 12. Compartment 12 is adjacent to second end 102 of body 10 and intercommunicates with an end of connection hole 13. A cap 121 is mounted to an outer end of compartment 12 opposite to connection hole 13. The other end of connection hole 13 intercommunicates with an end of transmission groove 14. The other end of transmission groove 14 intercommunicates with driving hole 11. A cover 112 is mounted to first end 101 of body 10 to seal a side of driving hole 11. A retainer 113 is mounted in driving hole 11 and engages with the cover 112.

In this embodiment, body 10 includes a head 15, a handle 16 adapted to be held by a user, and an extension 17 between head 15 and handle 16. Head 15 is located on first end 101 of body 10. Handle 16 is located between extension 17 and second end 102 of body 10 along first axis L1. Head 15 includes driving hole 11 and transmission groove 14. Transmission groove 14 is crescent in cross section and includes two closed ends spaced from each other in a transverse direction perpendicular to first axis L1. Handle 16 includes compartment 12. Handle 16 further includes a through-hole 18 extending in a radial direction perpendicular to first axis L1. Through-hole 18 intercommunicates with compartment 12. Connection hole 13 is defined in extension 17.

Driving device 20 is mounted to first end 101 of body 10. Driving device 20 includes a driving member 21, a pawl device 22, a first ring gear 23 rotatably mounted around driving member 21, and a second ring gear 24 rotatably mounted around driving member 21. Driving member 21 is rotatably mounted in body 10 and is rotatable about a second axis L2 perpendicular to first axis L1. An end of driving member 21 adjacent to second ring gear 24 is adapted for directly or indirectly driving a fastener. In the form shown, the end of driving member 21 can couple with a socket or an extension rod for driving a faster, such as a bolt, a nut, etc.

Pawl device 22 is mounted between first and second ring gears 23 and 24 and includes two primary pawls 221, a first secondary pawl 222, and a second secondary pawl 223. Each primary pawl 221 is pivotably mounted to driving member 21 and is configured to selectively mesh with toothed portion 111 of body 10.

One of the two primary pawls 221 and first secondary pawl 222 are jointly pivotable relative to driving member 21 about a third axis L3 parallel to the second axis L2. In this embodiment, third axis L3 is defined by a first pin 25 extending through driving member 21, the one of the two primary pawls 221, and first secondary pawl 222. The other primary pawl 221 and second secondary pawl 223 are jointly pivotable relative to driving member 21 about a fourth axis L4 parallel to the second axis L2. In this embodiment, fourth axis L4 is defined by a second pin 26 extending through driving member 21, the other primary pawl 221, and the secondary pawl 223. Second axis L2 is located between third and fourth axes L3 and L4. Primary pawls 221 are located on the same level along second axis L2. First secondary pawl 222 and second secondary pawl 223 are opposed to each other in a diametric direction perpendicular to second axis L2 and are located on different levels along second axis L2. Primary pawls 221 are located between first and second secondary pawls 222 and 223 along second axis L2.

Each of first and second ring gears 23 and 24 is rotatable relative to driving member 21 in a clockwise direction or a counterclockwise direction. First and second ring gears 23 and 24 are located on two sides of driving member 21 along second axis L2. Each of first and second ring gears 23 and 24 includes an inner toothed portion 231, 241 on an inner periphery thereof and an end toothed portion 232, 242 on an end face thereof. End toothed portions 232 and 242 of first and second ring gears 23 and 24 face each other. First secondary pawl 222 is configured to selectively mesh with inner toothed portion 231 of first ring gear 23. Second secondary pawl 223 is configured to selectively mesh with inner toothed portion 241 of second ring gear 24. It can be appreciated that driving device 20 does not have to include second ring gear 24 if desired.

Elastic device 30 is mounted in driving hole 11 and is located between cover 112 and first ring gear 23. Elastic device 30 includes an elastic member 31 and an abutment member 32. In this embodiment, elastic member 31 is an annular wave spring mounted around driving member 21 at a location adjacent to first ring gear 23 and mounted between first ring gear 23 and abutment member 32. Abutment member 32 is mounted in driving hole 11 of body 10 and abuts cover 112.

Power device 40 is received in compartment 12 of body 10 and includes a motor 41, a power source 42, and a control button 43. Cap 121 is detachably mounted to the outer end of compartment 12 to avoid power device 40 from falling out of compartment 12 while permitting replacement of power source 42 after detaching cap 121. In this embodiment, motor 41 is a monodirectional motor and includes a motor shaft 411. Power source 42 is electrically connected to motor 41 for driving motor shaft 411 to rotate about first axis L1. Control button 43 is received in through-hole 18 of body 10 and is electrically connected to motor 41. Control button 43 can be operated to control motor 41.

Transmission device 50 includes a transmission shaft 51 mounted in connection hole 13 of body 10 and is rotatable about first axis L1. Transmission shaft 51 includes a first end connected to motor shaft 411 and a second end having a gear 511. Gear 511 normally meshes with end toothed portions 232 and 242 of first and second ring gears 23 and 24. Gear 511 is switchable between a meshing state meshed with end toothed portions 232 and 242 of first and second ring gears 23 and 24 and a disengagement state disengaged from end toothed portions 232 and 242 of first and second ring gears 23 and 24.

Transmission device 50 further includes a restraining member 52 mounted in first end 101 of body 10 in a location between connection hole 13 and transmission groove 14. Restraining member 52 receives transmission shaft 51 and includes a restraining groove 521 extending in a radial direction perpendicular to first axis L1. Thus, transmission shaft 51 extends through and is restrained by restraining groove 521, such that when transmission shaft 51 is in the disengaged state and deviates away from first axis L1, the second end of transmission shaft 51 with gear 511 deviates along an axis parallel to second axis L2 to avoid transmission shaft 51 from vibrating in connection hole 13.

In this embodiment, the electric ratchet wrench further includes a direction switching device 60 having a direction switching rod 61 pivotably extending through cover 112 and driving member 21. Direction switching rod 61 is pivotable about second axis L2 relative to driving member 21 between two positions respectively corresponding to a driving direction and a non-driving direction. When direction switching rod 61 pivots between the two positions, an engagement status between each primary pawl 221 and toothed portion 111 of body 10 and an engagement status between first and second secondary pawls 222 and 223 and first and second ring gears 23 and 24 are changed to provide a direction switching function, which can be appreciated by one having ordinary skill in the art. Thus, the user can pivot direction switching rod 61 about second axis L2 to change the pressing direction of the two first pressing members 621 against the two primary pawls 221, the pressing direction of second pressing member 631 of one of the two secondary pressing members 63 against first secondary pawl 222, and the pressing direction of second pressing member 631 of the other secondary pressing member 63 against second secondary pawl 223.

In this embodiment, direction switching rod 61 includes a through-hole 611 extending in a diametric direction perpendicular to second axis L2. Direction switching rod 61 further includes first and second receptacles 612. Through-hole 611 of direction switching rod 61 is located between first and second receptacles 612 along second axis L2. Each of the first and second receptacles 612 has an opening. The openings of first and second receptacles 612 face away from each other and are diametrically opposed to each other.

In this embodiment, direction switching device 60 further includes a primary pressing unit 62 and two secondary pressing units 63. Primary pressing unit 62 is mounted in through-hole 611 of direction switching rod 61 and includes two first pressing members 621 and a first biasing element 622 mounted between the two first pressing members 621 and biasing the two first pressing members 621 to respectively press against the two primary pawls 221. Each of the two secondary pressing units 63 includes a second pressing member 631 and a second biasing element 632. One of the two secondary pressing units 63 is mounted in first receptacle 612 of direction switching rod 61. The second biasing element 632 received in first receptacle 612 biases the second pressing member 631 received in first receptacle 612 to press against first secondary pawl 222. The other of the two secondary pressing units 63 is mounted in second receptacle 612 of direction switching rod 61. The second biasing member 632 received in second receptacle 612 biases the second pressing member 631 received in second receptacle 612 to press against second secondary pawl 223.

In this embodiment, direction switching device 60 further includes a return spring 64 in the form of a coil spring mounted around direction switching rod 61. Return spring 64 is mounted between a head of direction switching rod 61 and cover 112. Direction switching rod 61 can move relative to driving member 21 along second axis L2 between an initial position and a disengagement position. Driving member 21 can couple with a socket when direction switching rod 61 is in the initial position, and the socket cannot be disengaged from driving member 21. On the other hand, when direction switching rod 61 is moved to the disengagement position, the socket can be disengaged from driving member 21, and return spring 64 is compressed. Return spring 64 provides a returning force for returning direction switching rod 61 from the disengagement position to the initial position. Thus, direction switching rod 61 is normally in the initial position.

Gear 511 of transmission shaft 51 normally meshes with end toothed portions 232 and 242 of first and second ring gears 23 and 24. When motor shaft 411 of motor 41 drives transmission shaft 51 to rotate about first axis L1, first and second ring gears 23 and 24 are driven to respectively rotate in the clockwise direction or the counterclockwise direction relative to driving member 21. Primary pawls 221 and one of first and second secondary pawls 222 and 223 actuate driving member 21 to rotate to thereby directly or indirectly rotate a fastener. Thus, the electric ratchet wrench can drive driving member 21 to rotate about second axis L2 by rotating motor shaft 411 of motor 41 about first axis L1 without moving handle 16.

If a resistance smaller than a torque outputted by motor 41 is encountered while driving member 21 is driving a fastener, transmission shaft 51 is in the meshing state meshing with end toothed portions 232 and 242 and, thus, drives first and second ring gears 23 and 24 to rotate, driving member 21 is rotated to continuously drive the fastener.

Figure 8:
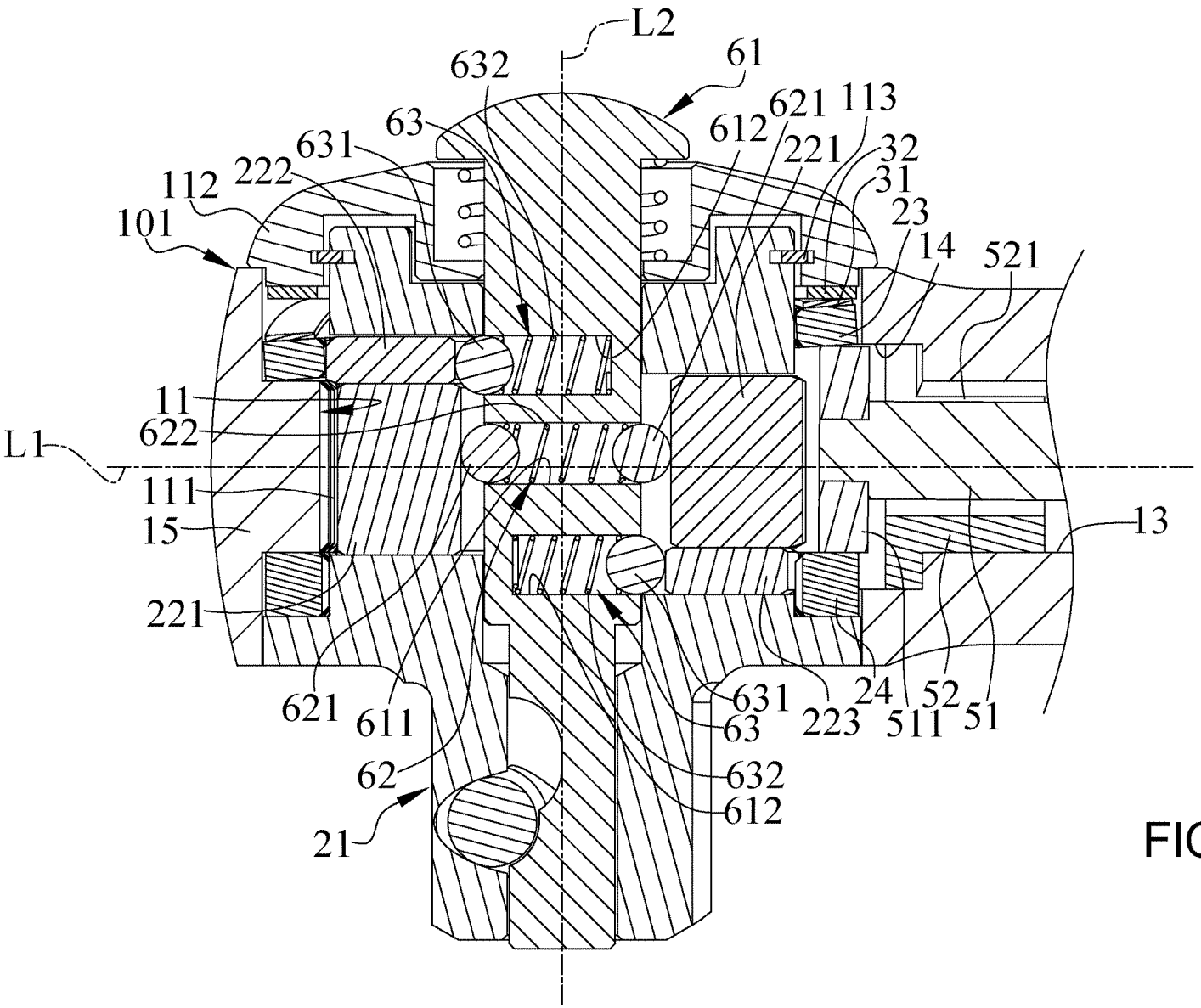
FIG. 8 is a view similar to FIG. 4 with the gear of the transmission shaft disengaged from the first and second ring gears and with an elastic member compressed.

With reference to FIG. 8, on the other hand, if a large resistance larger than the torque outputted by motor 41 is encountered at a position while driving member 21 is driving the fastener (such as a rusted long bolt on a construction site), the torque outputted by motor shaft 411 is insufficient to drive transmission shaft 51 to rotate driving member 21. Namely, driving member 21 cannot drive the fastener. Gear 511 of transmission shaft 51 is in the disengaged state, and transmission shaft 51 deviates from first axis L1. Gear 511 of transmission shaft 51 presses against first ring gear 23 to slightly move relative to body 10 along second axis L2 and to compress elastic member 31. Thus, a tooth slippage phenomenon occurs between gear 511 of transmission shaft 51 and toothed portions 232 and 242 of first and second ring gears 23 and 24. Namely, gear 511 of transmission shaft 51 repeatedly engages with and disengages from end toothed portions 232 and 242 of first and second ring gears 23 and 24, such that first and second ring gears 23 and 24 cannot be rotated by gear 511. The user can hear clicks resulting from the tooth slippage phenomenon and, thus, be aware of failure of engagement between gear 511 and end toothed portions 232 and 242 of first and second ring gears 23 and 24. In this case, the user can manually rotate handle 16, using toothed portion 111 of body 10 to mesh with one of primary pawls 221. Thus, driving member 21 is driven by body 10 to drive the fastener. After the fastener passes through the large-resistance position, gear 511 of transmission shaft 51 reengages with end toothed portions 232 and 242 of first and second ring gears 23 and 24 under the action of elastic member 31 of elastic device 30. Thus, driving member 21 can be driven by motor 41 again to rotate about second axis L2 to thereby drive the fastener to rotate. Thus, the problems of conventional non-manually-driven ratchet wrenches resulting from excessive large resistances are overcome.

Figure 9:
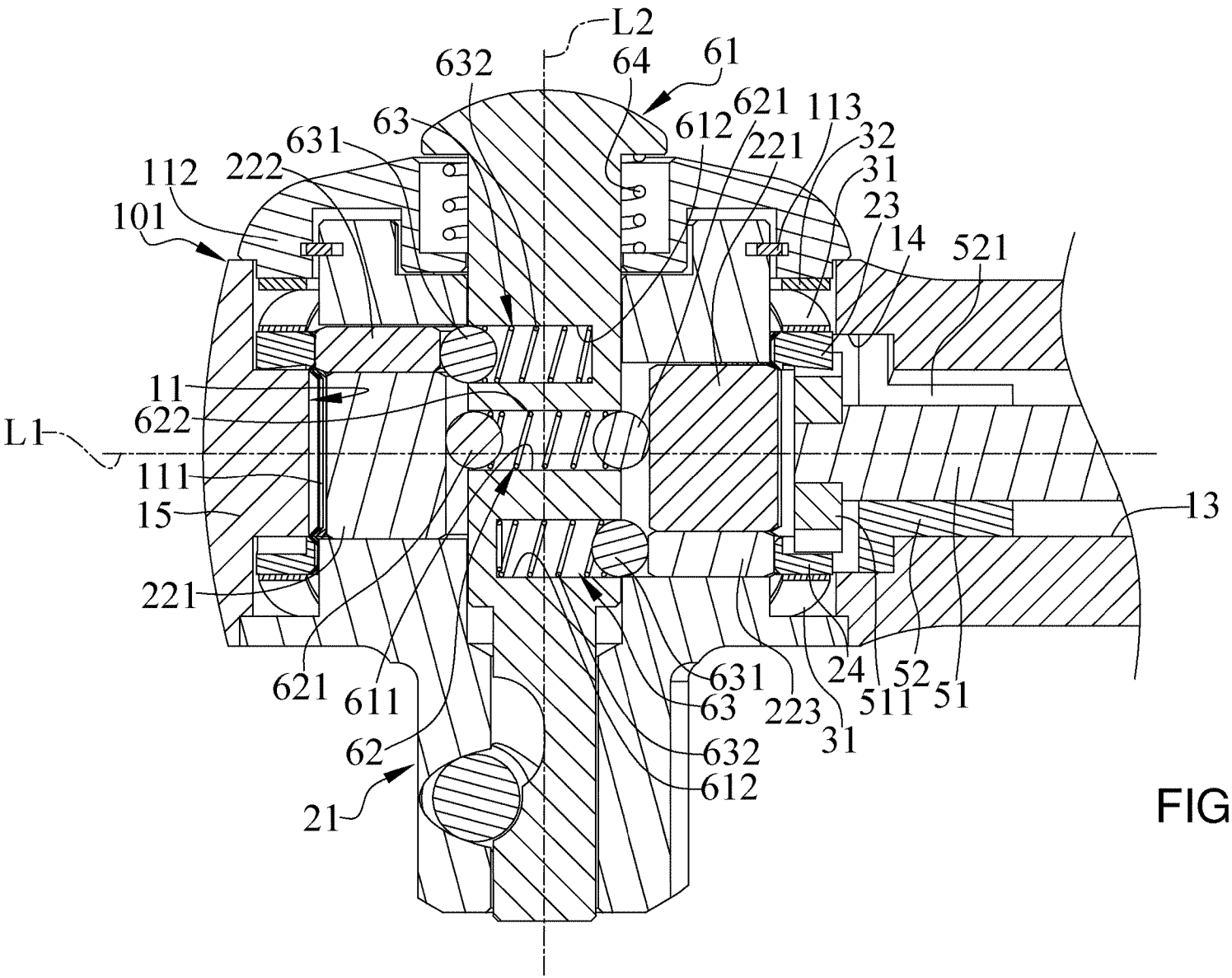
FIG. 9 is a cross sectional view illustrating an electric ratchet wrench of a second embodiment according to the present invention, with the electric ratchet wrench having two elastic members and with the gear of the transmission shaft meshed with the first and second ring gears.
Figure 10:
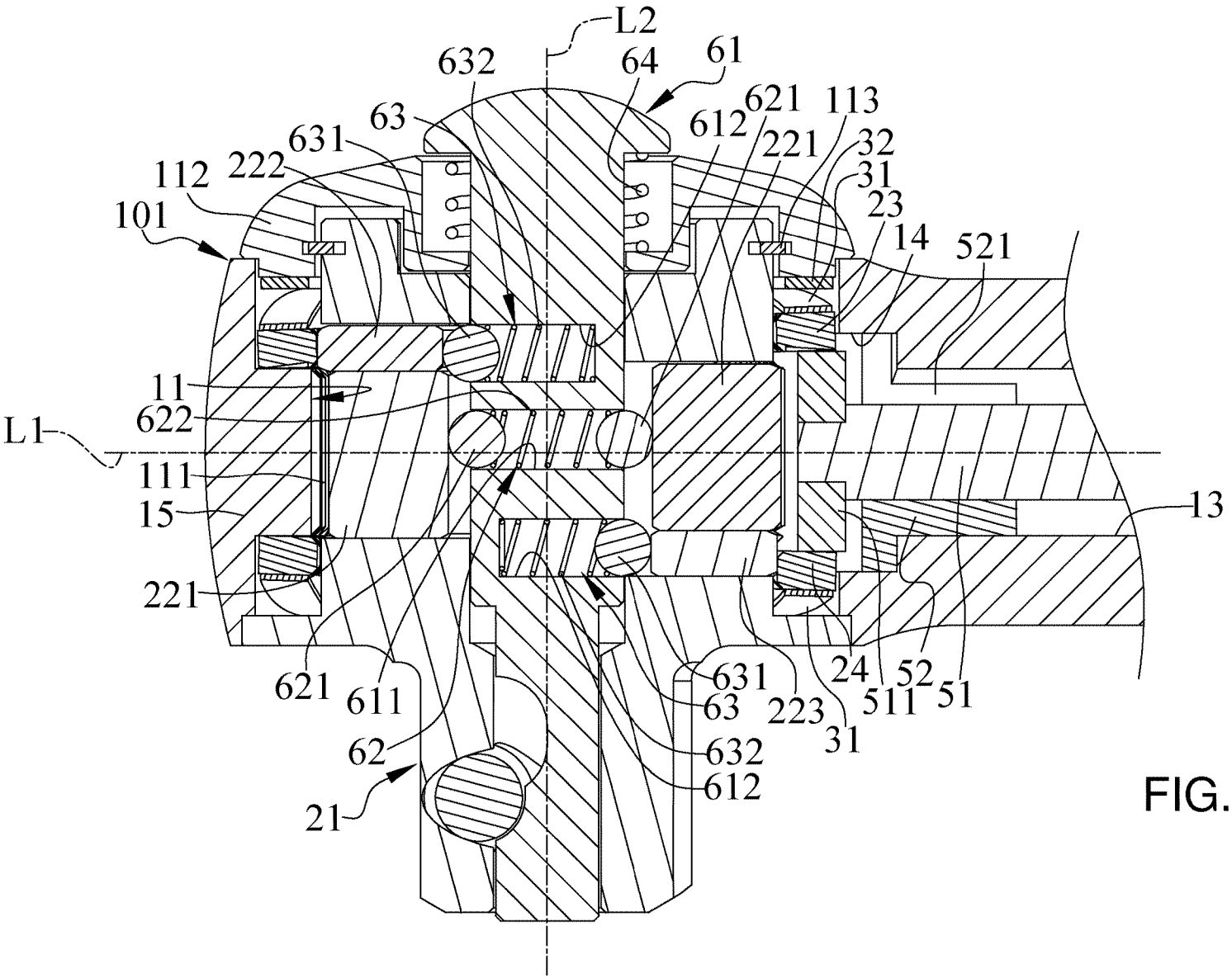
FIG. 10 is a view similar to FIG. 9 with the gear of the transmission shaft disengaged from the first and second ring gears and with the two elastic members compressed.

FIGS. 9 and 10 show an electric ratchet wrench of a second embodiment according to the present invention. The second embodiment is substantially the same as the first embodiment except that elastic device 30 includes two elastic members 31 in the form of wave springs. One of the two elastic members 31 is mounted between first ring gear 23 and abutment member 32. The other elastic member 31 is mounted between second ring gear 24 and driving member 21. When gear 511 of transmission shaft 51 is in the disengaged state and when transmission shaft 51 deviates from first axis L1, gear 511 of transmission shaft 51 presses against first ring gear 23 and second ring gear 24 to slightly move relative to body 10 along second axis L2 and to compress the two elastic members 31. Thus, a tooth slippage phenomenon occurs. Namely, gear 511 of transmission shaft 51 repeatedly engages with and disengages from end toothed portions 232 and 242 of first and second ring gears 23 and 24, such that first and second ring gears 23 and 24 cannot be rotated by gear 511. The user can hear clicks resulting from the tooth slippage phenomenon and, thus, be aware of failure of engagement between gear 511 and end toothed portions 232 and 242 of first and second ring gears 23 and 24. In this case, the user can manually rotate handle 16, using toothed portion 111 of body 10 to mesh with one of primary pawls 221. Thus, driving member 21 is driven by body 10 to drive the fastener. After the fastener passes through the large-resistance position, gear 511 of transmission shaft 51 reengages with end toothed portions 232 and 242 of first and second ring gears 23 and 24 under the action of elastic members 31 of elastic device 30. Thus, driving member 21 can be driven by motor 41 again to rotate about second axis L2 to thereby drive the fastener to rotate. Thus, the problems of conventional non-manually-driven ratchet wrenches resulting from excessive large resistances are overcome.

Figures 11, 12:
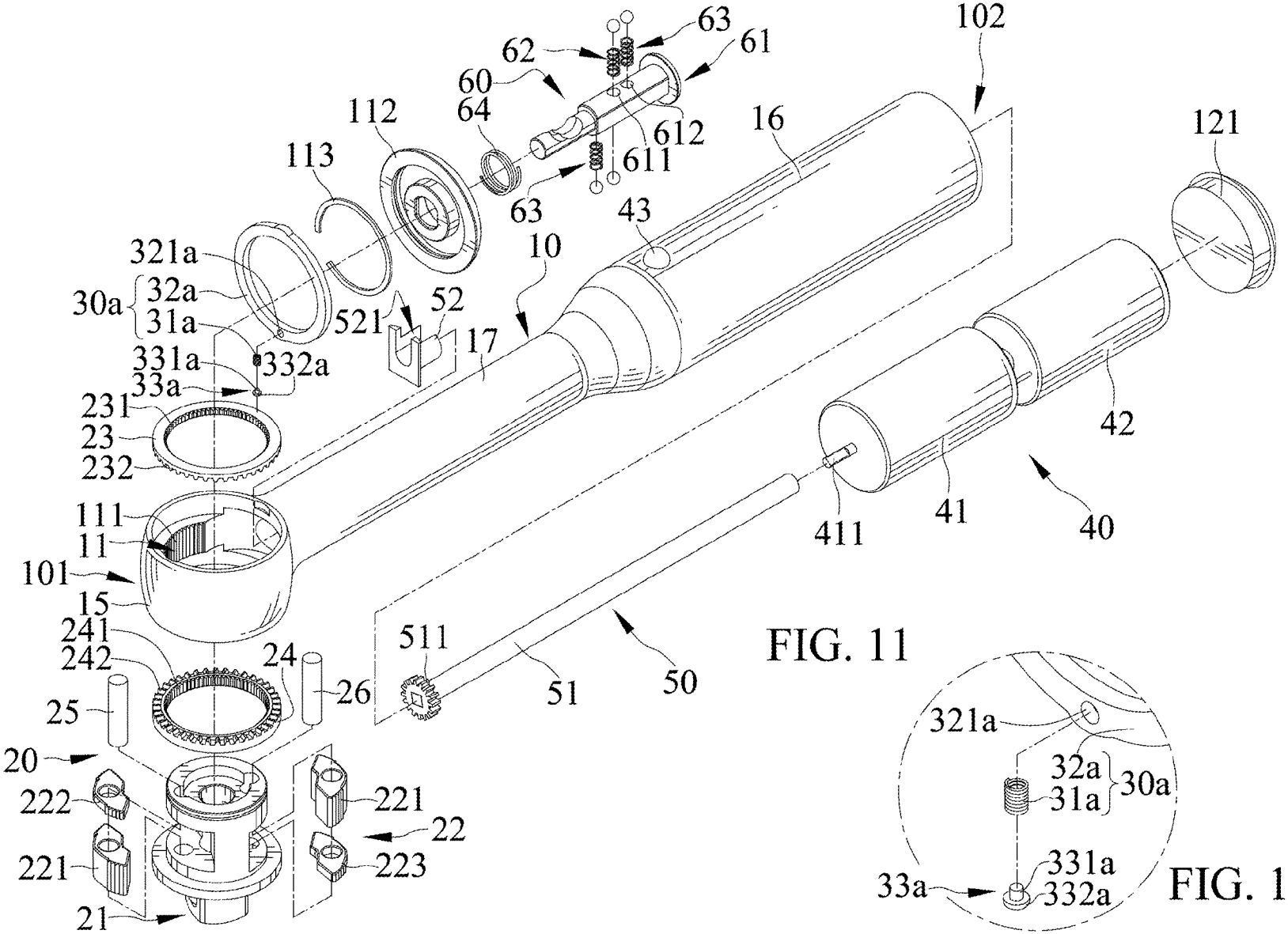
FIG. 11 is an exploded, perspective view of an electric ratchet wrench of a third embodiment according to the present invention.
FIG. 12 is an enlarged view of a portion of the electric ratchet wrench of FIG. 11.
Figure 13:
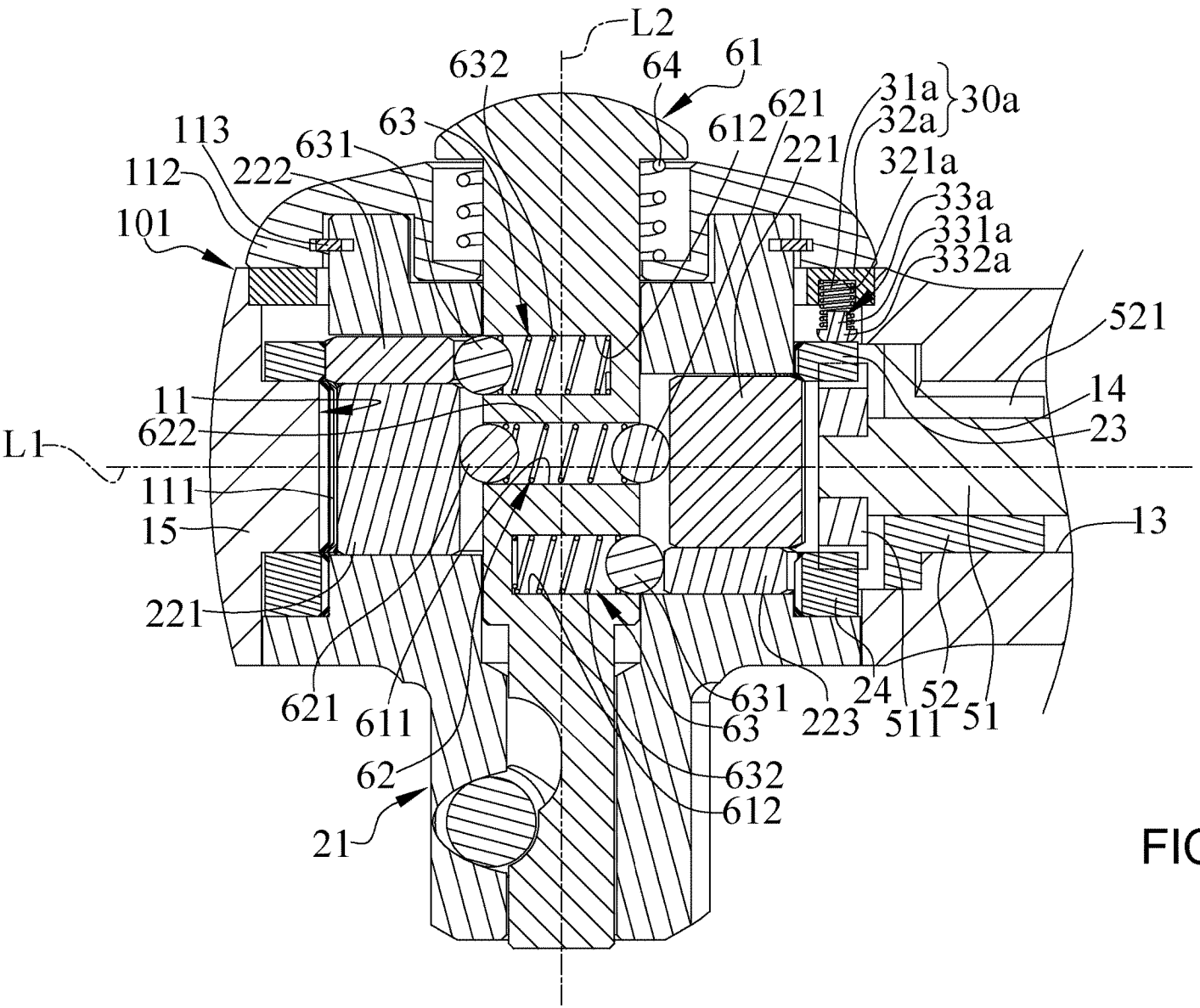
FIG. 13 is a partial, cross sectional view of the electric ratchet wrench of FIG. 11 after assembly, with the gear of the transmission shaft meshed with the first and second ring gears.

FIGS. 11-13 show an electric ratchet wrench of a third embodiment according to the present invention. The third embodiment is substantially the same as the first embodiment except that elastic member 31*a* of elastic device 30*a* is in the form of a coil spring, and abutment member 32*a* includes a positioning groove 321*a* extending along an axis parallel to second axis L2 and aligned with gear 511 of transmission shaft 51. Positioning groove 321*a* has an opening facing first ring gear 23. In this embodiment, positioning groove 321*a* is located adjacent to gear 511 of transmission shaft 51. Elastic device 30*a* further includes a spring seat 33*a* having a connection section 331*a* and an abutment section 332*a* integrally formed with connection section 331*a*. Each of connection section 331*a* and abutment section 332*a* has circular cross sections. Connection section 331*a* has an outer diameter smaller than an outer diameter of abutment section 332*a*.

Elastic member 31*a* is mounted between abutment member 32*a* and first ring gear 23 and is located adjacent to gear 511 of transmission shaft 51. Elastic member 31 received in positioning groove 321*a* extends along the axis parallel to second axis L2 and is aligned with gear 511 of transmission shaft 51. A first end of elastic member 31*a* is engaged in positioning groove 321*a* of abutment member 32*a*. A second end of elastic member 31*a* is mounted around connection section 331*a* of spring seat 33*a*. Abutment section 332*a* of spring seat 33*a* abuts first ring gear 23. Thus, elastic member

31*a* is prevented from disengaging from between first ring gear 23 and abutment member 32*a* while avoiding direction friction between elastic member 31*a* and first ring gear 23.

When gear 511 of transmission shaft 51 is in the disengaged state and when transmission shaft 51 deviates from first axis L1, gear 511 of transmission shaft 51 presses against first ring gear 23 to slightly move relative to body 10 along second axis L2 and to compress elastic member 31*a*. Thus, a tooth slippage phenomenon occurs. Namely, gear 511 of transmission shaft 51 repeatedly engages with and disengages from end toothed portions 232 and 242 of first and second ring gears 23 and 24, such that first and second ring gears 23 and 24 cannot be rotated by gear 511. The user can hear clicks resulting from the tooth slippage phenomenon and, thus, be aware of failure of engagement between gear 511 and end toothed portions 232 and 242 of first and second ring gears 23 and 24. In this case, the user can manually rotate handle 16, using toothed portion 111 of body 10 to mesh with one of primary pawls 221. Thus, driving member 21 is driven by body 10 to drive the fastener. After the fastener passes through the large-resistance position, gear 511 of transmission shaft 51 reengages with end toothed portions 232 and 242 of first and second ring gears 23 and 24 under the action of elastic member 31*a* of elastic device 30*a*. Thus, driving member 21 can be driven by motor 41 again to rotate about second axis L2 to thereby drive the fastener to rotate. Thus, the problems of conventional ratchet wrenches resulting from excessive large resistances are overcome.

Figure 14:
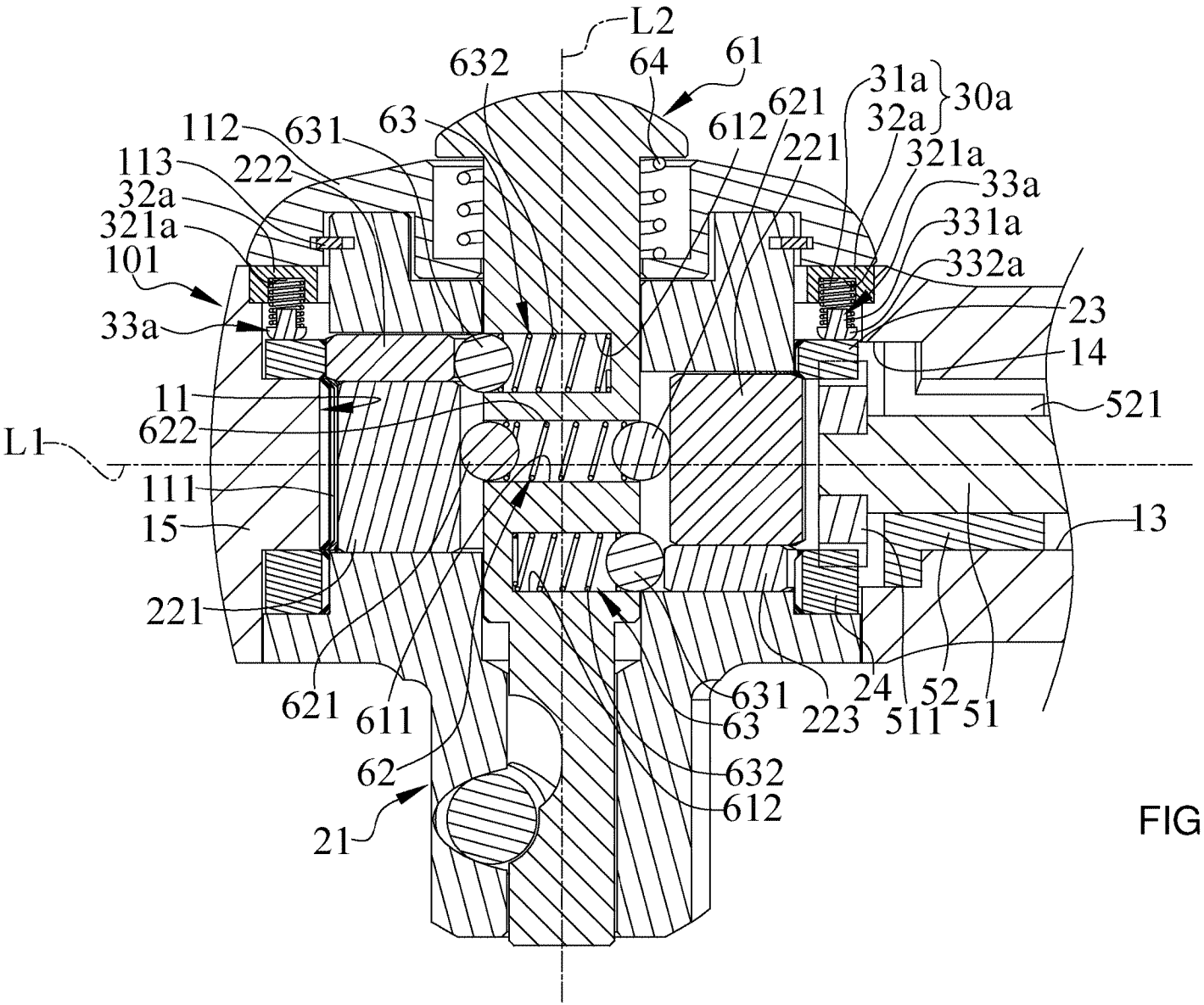
FIG. 14 is a partial, cross sectional view of an electric ratchet wrench of a fourth embodiment according to the present invention.

FIG. 14 shows an electric ratchet wrench of a fourth embodiment according to the present invention. The fourth embodiment is substantially the same as the third embodiment except that elastic device 30*a* includes two positioning grooves 321*a*, two elastic members 31*a*, and two spring seats 33*a*. In this embodiment, both of the elastic members 31*a* are coil springs and are mounted between first ring gear 23 and abutment member 32*a*. Each positioning groove 321*a* extends along an axis parallel to second axis L2. One of the positioning groove 321*a* is aligned with gear 511 of transmission shaft 51. Each positioning groove 321*a* has an opening facing first ring gear 23. The two positioning grooves 321*a* are diametrically opposed to each other relative to second axis L2, such that the two elastic members 31*a* are diametrically opposed to each other relative to second axis L2. Furthermore, the two spring seats 33*a* are also diametrically opposed to each other relative to second axis L2. In this embodiment, one of the two positioning grooves 321*a* is located adjacent to compartment 12 of transmission shaft 51. The other positioning groove 321*a* is located adjacent to toothed portion 111 of body 10. One of the two elastic members 31*a* is located adjacent to gear 511 of transmission shaft 51. The other elastic member 31*a* is located adjacent to toothed portion 111 of body 10.

The first end of each elastic member 31*a* is engaged in one of the two positioning grooves 321*a* of abutment member 32*a*. The second end of each elastic member 31*a* is mounted around connection section 331*a* of one of the two spring seats 33*a*. Abutment section 332*a* of each of the two spring seats 33*a* abuts first ring gear 23. Since the two spring seats 33*a* are diametrically opposed to each other relative to the second axis L2 and abut first ring gear 23, the elastic forces of the two elastic members 31*a* can evenly press against first gear 23 through the two spring seats 33*a*.

When gear 511 of transmission shaft 51 is in the disengaged state and when transmission shaft 51 deviates from first axis L, gear 511 of transmission shaft 51 presses against first ring gear 23 to slightly move relative to body 10 along second axis L2 and to compress the two elastic members 31*a*. Thus, a tooth slippage phenomenon occurs. Namely, gear 511 of transmission shaft 51 repeatedly engages with and disengages from end toothed portions 232 and 242 of first and second ring gears 23 and 24, such that first and second ring gears 23 and 24 cannot be rotated by gear 511. The user can hear clicks resulting from the tooth slippage phenomenon and, thus, be aware of failure of engagement between gear 511 and end toothed portions 232 and 242 of first and second ring gears 23 and 24. In this case, the user can manually rotate handle 16, using toothed portion 111 of body 10 to mesh with one of primary pawls 221. Thus, driving member 21 is driven by body 10 to drive the fastener. After the fastener passes through the large-resistance position, gear 511 of transmission shaft 51 reengages with end toothed portions 232 and 242 of first and second ring gears 23 and 24 under the action of the two elastic members 31*a* of elastic device 30*a*. Thus, driving member 21 can be driven by motor 41 again to rotate about second axis L2 to thereby drive the fastener to rotate. Thus, the problems of conventional ratchet wrenches resulting from excessive large resistances are overcome.

In view of the foregoing, the electric ratchet wrench according to the present invention can drive driving member 21 to rotate about second axis L2 by rotating motor shaft 411 of motor 41 about first axis L1 without moving handle 16. A force-saving effect is, thus, provided.

Furthermore, if a large resistance larger than the torque outputted by motor shaft 411 is encountered at a position while driving member 21 is driving the fastener, gear 511 of transmission shaft 51 is in the disengaged state, and transmission shaft 51 deviates from first axis L1. Gear 511 of transmission shaft 51 presses against first ring gear 23 to slightly move relative to body 10 along second axis L2 and to compress elastic members 31, 31*a*. Thus, a tooth slippage phenomenon occurs. Namely, gear 511 of transmission shaft 51 repeatedly engages with and disengages from end toothed portions 232 and 242 of first and second ring gears 23 and 24, such that first and second ring gears 23 and 24 cannot be rotated by gear 511. The user can hear clicks resulting from the tooth slippage phenomenon and, thus, be aware of failure of engagement between gear 511 and end toothed portions 232 and 242 of first and second ring gears 23 and 24. In this case, the user can manually rotate handle 16, using toothed portion 111 of body 10 to mesh with one of primary pawls 221. Thus, driving member 21 is driven by body 10 to drive the fastener. After the fastener passes through the large-resistance position, gear 511 of transmission shaft 51 reengages with end toothed portions 232 and 242 of first and second ring gears 23 and 24 under the action of elastic member 31, 31*a* of elastic device 30, 30*a*. Thus, driving member 21 can be driven by motor 41 again to rotate about second axis L2 to thereby drive the fastener to rotate. Thus, the problems of conventional non-manually-driven ratchet wrenches resulting from excessive large resistances are overcome.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An electric ratchet wrench comprising:

a body, arranged along a first axis;

a driving member rotatably mounted in the body and being rotatable about a second axis;

a first ring gear rotatably mounted to and moveable relative to the driving member, with the first ring gear rotatable relative to the driving member in a clockwise direction or a counterclockwise direction about a center axis of the first ring gear;

a second ring gear rotatably mounted around the drive member;

a power device received in the body;

a transmission shaft rotatably mounted to the body, with the transmission shaft including a first end connected to the power device, and a second end configured to switch between a meshing state meshed with the first ring gear and a disengagement state operably disengaging from the first ring gear; and an elastic device biasing the first ring gear towards the transmission shaft and from the disengagement state to the meshing state, with the elastic device causing the center axis of the first ring gear to be inclined relative to a center axis of the second ring gear in the disengagement state and being common with the center axis of the second ring gear in the meshing state;

wherein when considered from the position of the second end of the transmission shaft, the first end of the transmission shaft is located on an input side of a torque transfer mechanism and the driving member is located on an output side of the torque transfer mechanism.

2. The electric ratchet wrench as claimed in claim 1, with the body including a first end and a second end spaced from the first end along a first axis, with the first end of the body including an inner periphery having a toothed portion, with a driving device mounted to the first end of the body, with the driving device including the driving member, a pawl device pivotably mounted to the driving member, and the first ring gear rotatably mounted around the driving member, with the driving member including an end adapted for directly or indirectly driving a fastener, with the pawl device configured to selectively mesh with the toothed portion of the body, with the first ring gear including an inner toothed portion on an inner periphery thereof and an end toothed portion on an end face thereof, with the inner toothed portion of the first ring gear configured to selectively mesh with the pawl device, with the elastic device mounted between the first end of the body and the first ring gear, with the power device received in the second end of the body and including a motor, with a transmission device including the transmission shaft having the first end connected to the motor and the second end configured to switch between the meshing state meshed with the end toothed portion of the first ring gear and the disengagement state operatively disengaging from the end toothed portion of the first ring gear.

3. The electric ratchet wrench as claimed in claim 2, with the body including a connection hole, with the transmission shaft received in the connection hole and rotatable about the first axis, with the second end of the transmission shaft including a gear normally meshed with the end toothed portion of the first ring gear, with the gear of the transmission shaft switchable between the meshing state and the disengagement state, with the transmission shaft deviating from the first axis when the gear of the transmission shaft is in the disengagement state, such that a tooth slippage phenomenon occurs between the gear of the transmission shaft and the end toothed portion of the first ring gear.

4. The electric ratchet wrench as claimed in claim 3, with the body further including a cover mounted to the first end of the body, with the elastic device mounted between the cover and the first ring gear, with the elastic device including a first elastic member and an abutment member, with the first elastic member located between the first ring gear and the abutment member, and with the abutment member mounted to the first end of the body and abutting the cover.

5. The electric ratchet wrench as claimed in claim 4, with the first elastic member being a wave spring mounted around the driving member.

6. The electric ratchet wrench as claimed in claim 5, with the driving device further including the second ring gear rotatably mounted around the driving member, with each of the first and second ring gears rotatable about the second axis perpendicular to the first axis in the clockwise direction or the counterclockwise direction, with the second ring gear including an inner toothed portion on an inner periphery thereof and an end toothed portion on an end face thereof, with the gear of the transmission shaft normally meshed with the end toothed portions of the first and second ring gears, with the gear of the transmission shaft switchable between the meshing state and the disengagement state, with the pawl device including two primary pawls, a first secondary pawl, and a second secondary pawl, with each of the two primary pawls pivotably mounted to the driving member and configured to selectively mesh with the toothed portion of the body, with the inner toothed portion of the first ring gear configured to selectively mesh with the first secondary pawl, with the inner toothed portion of the second ring gear configured to selectively mesh with the second secondary pawl;

wherein when the gear of the transmission shaft is in the meshing state, the gear of the transmission shaft meshes with the end toothed portions of the first and second ring gears; and wherein when the gear of the transmission shaft is in the disengagement state, the tooth slippage phenomenon occurs between the gear of the transmission shaft and the end toothed portions of the first and second ring gears, and the gear of the transmission shaft presses the first ring gear to move relative to the body and compress the first elastic member of the elastic device.

7. The electric ratchet wrench as claimed in claim 6, with the elastic device further including a second elastic member mounted between the second ring gear and the driving member.

8. The electric ratchet wrench as claimed in claim 6, further comprising a direction switching device including a direction switching rod extending through the driving member along the second axis perpendicular to the first axis, with the direction switching rod pivotable relative to the driving member between two positions respectively corresponding to a driving direction and a non-driving direction, with the pawl device including two primary pawls, a first secondary pawl, and a second secondary pawl, with the two primary pawls configured to selectively mesh with the toothed portion of the body, with the inner toothed portion of the first ring gear configured to selectively mesh with the first secondary pawl, with the inner toothed portion of the second ring gear configured to selectively mesh with the second secondary pawl, wherein when the direction switching rod pivots between the two positions, an engagement status between each of the two primary pawls and the toothed portion of the body and an engagement status between the first and second secondary pawls and the first and second ring gears are changed to provide a direction switching function.

9. The electric ratchet wrench as claimed in claim 8, with the body including a head, a handle adapted to be held by a user, and an extension between the head and the handle, with the head located on the first end of the body, with the handle located between the extension and the second end of the body along the first axis, with the head including a driving hole and a transmission groove intercommunicated with the driving hole, with the driving hole including the inner periphery having the toothed portion, with the handle including a compartment receiving the power device, with the connection hole defined in the extension, with the handle of the body including a through-hole extending in a radial direction perpendicular to the first axis, with the through-hole intercommunicated with the compartment, with the power device further including a power source and a control button, with the motor including a motor shaft, with the power source electrically connected to the motor for driving the motor shaft to rotate, with the motor being a monodirectional motor, with the motor shaft and the transmission shaft rotatable about the first axis, with the control button received in the through-hole of the body and electrically connected to the motor, and with the control button operable to control the motor.

10. The electric ratchet wrench as claimed in claim 9, with the driving device further including first and second pins, with the driving member rotatably mounted in the body and rotatable about the second axis, with the first pin extending through the driving member, one of the two primary pawls, and the first secondary pawl, permitting the one of the two primary pawls and the first secondary pawl to jointly pivot relative to driving member about a third axis parallel to the second axis and defined by the first pin, with the second pin extending through another of the two primary pawls and the second secondary pawl, permitting the other of the two primary pawls and the second secondary pawl to jointly pivot relative to driving member about a fourth axis parallel to the second axis and defined by the second pin, with the second axis located between the third and fourth axes, with the two primary pawls located on a same level along the second axis, with the first secondary pawl and the second secondary pawl opposed to each other in a diametric direction perpendicular to the second axis and located on different levels along the second axis, and with the two primary pawls located between the first and second secondary pawls along the second axis.

11. The electric ratchet wrench as claimed in claim 10, with the direction switching rod including a through-hole extending in a diametric direction perpendicular to the second axis, with the direction switching rod further including first and second receptacles, with the through-hole of the direction switching rod located between the first and second receptacles along the second axis, with each of the first and second receptacles having an opening, with the openings of the first and second receptacles facing away from each other and diametrically opposed to each other, with the direction switching device further including a primary pressing unit and two secondary pressing units, with the primary pressing unit mounted in the through-hole of the direction switching rod and including two first pressing members and a first biasing element mounted between the two first pressing members and biasing the two first pressing members to respectively press against the two primary pawls, with each of the two secondary pressing units including a second pressing member and a second biasing element, with one of the two secondary pressing units mounted in the first receptacle of the direction switching rod, with the second biasing element received in the first receptacle biasing the second pressing member received in the first receptacle to press against the first secondary pawl, with another of the two secondary pressing units mounted in the second receptacle of the direction switching rod, and with the second biasing member received in the second receptacle biasing the second pressing member received in the second receptacle to press against the second secondary pawl.

12. The electric ratchet wrench as claimed in claim 2, with the body including a connection hole, with the transmission shaft received in the connection hole and rotatable about the first axis, with the second end of the transmission shaft including a gear normally meshed with the end toothed portion of the first ring gear, with the gear of the transmission shaft switchable between the meshing state and the disengagement state, with the transmission shaft deviating from the first axis when the gear of the transmission shaft is in the disengagement state, and with the gear of the transmission shaft pressing the first ring gear to move relative to the body and to compress the elastic device.

13. The electric ratchet wrench as claimed in claim 2, with the body including a connection hole, with the transmission shaft received in the connection hole and rotatable about the first axis, with the second end of the transmission shaft including a gear normally meshed with the end toothed portion of the first ring gear, with the gear of the transmission shaft switchable between the meshing state and the disengagement state, and with the gear of the transmission shaft pressing the first ring gear to move relative to the body and to compress the elastic device when the gear of the transmission shaft is in the disengagement state.

14. The electric ratchet wrench as claimed in claim 2, with the first end of the transmission shaft being at a fixed location along the first axis, and with the first end of the transmission shaft remains at the fixed location while the transmission shaft shifts between the meshing and disengaging states.

15. The electric ratchet wrench as claimed in claim 3, with the transmission device further including a restraining member mounted in the first end of the body and receiving the transmission shaft, with the restraining member including a restraining groove extending in a radial direction perpendicular to the first axis, with the transmission shaft extending through and restrained by the restraining groove, such that when the transmission shaft deviates away from the first axis, the second end of the transmission shaft deviates along an axis parallel to a second axis perpendicular to the first axis.

16. The electric ratchet wrench as claimed in claim 4, with the first elastic member being a coil spring, with the abutment member including a first positioning groove having an opening facing the first ring gear, with the first elastic member having a first end engaged in the first positioning groove of the abutment member.

17. The electric ratchet wrench as claimed in claim 16, with the elastic device further including a first spring seat having a connection section and an abutment section integrally formed with the connection section, with the first elastic member further having a second end mounted around the connection section of the first spring seat, and with the abutment section of the first spring seat abutting the first ring gear.

18. The electric ratchet wrench as claimed in claim 16, with the driving device further including a second ring gear rotatably mounted around the driving member, with each of the first and second ring gears rotatable about the second axis perpendicular to the first axis in the clockwise direction or the counterclockwise direction, with the second ring gear including an inner toothed portion on an inner periphery thereof and an end toothed portion on an end face thereof, with the gear of the transmission shaft normally meshed with the end toothed portions of the first and second ring gears, with the gear of the transmission shaft switchable between the meshing state and the disengagement state, with the pawl device including two primary pawls, a first secondary pawl, and a second secondary pawl, with each of the two primary pawls pivotably mounted to the driving member and configured to selectively mesh with the toothed portion of the body, with the inner toothed portion of the first ring gear configured to selectively mesh with the first secondary pawl, with the inner toothed portion of the second ring gear configured to selectively mesh with the second secondary pawl;

wherein when the gear of the transmission shaft is in the meshing state, the gear of the transmission shaft meshes with the end toothed portions of the first and second ring gears; and wherein when the gear of the transmission shaft is in the disengagement state, the tooth slippage phenomenon occurs between the gear of the transmission shaft and the end toothed portion of the first ring gear, and the gear of the transmission shaft presses the first ring gear to move relative to the body and compresses the first elastic member of the elastic device.

19. The electric ratchet wrench as claimed in claim 18, with the abutment member further including a second positioning groove having an opening facing the first ring gear, with the elastic device further including a second elastic member and a second spring seat, with the second elastic member being a coil spring having first and second ends, with the second spring seat including a connection section and an abutment section integrally formed with the connection section, with the first end of the second elastic member engaged in the second positioning groove, with the second end of the second elastic member mounted around the connection section of the second spring seat, with the abutment section of the second spring seat abutting the first ring gear, and with the first and second spring seats diametrically opposed to each other relative to the second axis.

20. The electric ratchet wrench as claimed in claim 1, with the center axis of the first ring gear being coincides with the second axis in the meshing state.

* * * * *